US005641216A

United States Patent [19]

Grass

[11] Patent Number: 5,641,216

[45] Date of Patent: Jun. 24, 1997

[54] DRAWER SLIDE

[75] Inventor: Alfred Grass, Höchst/Vlbg., Austria

[73] Assignee: Grass AG, Hochst/Vlbg., Austria

[21] Appl. No.: 516,157

[22] Filed: Aug. 17, 1995

[30] Foreign Application Priority Data

Aug. 17, 1994 [DE] Germany ..... 9413108 U

[51] Int. Cl.[6] ..... A47B 88/00

[52] U.S. Cl. ..... 312/334.27; 312/334.12; 312/334.41; 312/334.4; 312/330.1; 312/334.1; 312/334.32

[58] Field of Search ..... 312/334.27, 333, 312/330.1, 334.39, 334.12, 334.1, 334.41, 334.44, 334.14, 334.15, 334.23, 334.24, 334.25, 334.29, 334.31, 334.32, 334.33, 334.34, 334.45

[56] References Cited

U.S. PATENT DOCUMENTS

| | | | |
|---|---|---|---|
| 1,321,167 | 11/1919 | Voigt | 312/334.41 X |
| 3,387,907 | 6/1968 | Wall | 312/334.41 |
| 3,658,399 | 4/1972 | Vogt | 312/334.41 |
| 4,141,525 | 2/1979 | Miller | 312/334.4 X |
| 4,176,890 | 12/1979 | Gorton | 312/334.41 |
| 4,387,942 | 6/1983 | Lense | 312/334.41 X |
| 4,458,964 | 7/1984 | Hardy | 312/334.12 |
| 4,759,341 | 7/1988 | McFarland | 312/334.27 X |
| 5,275,483 | 1/1994 | Rasmussen | 312/334.27 X |

FOREIGN PATENT DOCUMENTS

| | | | |
|---|---|---|---|
| 2726884 | 1/1978 | Germany | 312/334.4 |

*Primary Examiner*—Peter M. Cuomo
*Assistant Examiner*—James O. Hansen
*Attorney, Agent, or Firm*—Kilpatrick Stockton LLP

[57] ABSTRACT

A drawer slide, includes a cabinet body rail and a drawer rail with rollers and corresponding slide tracks and the cabinet body rail and the drawer rail are placed next to each other on the underside of the drawer bottom.

4 Claims, 6 Drawing Sheets

DRAWER SLIDE

FIELD AND BACKGROUND OF THE INVENTION

The object of the invention is a drawer slide, of the type having a cabinet body rail and a drawer rail.

Drawer slides are already known which consist of a cabinet body rail and a corresponding drawer rail. Up to now, both these rails were placed on each other and were fastened on the side wall of the drawer.

The disadvantage of this embodiment is that the available standing width for the installation of the drawer is diminished by the slide rails. Thus, the possible holding volume or capacity of the drawer is unnecessarily reduced.

It is likewise already known, that in order to attain a larger drawer width, the corresponding slide rails are placed under the drawer bottom. By all means, therein lies the disadvantage that the drawer height is restricted based on the placement of the rails one upon the other.

The current state of technology also has the collective disadvantage that the drawer volume is very limited and restricted due to the currently known slide rails.

The submitted invention is based on the task of making a drawer slide available, which has a greater carrying capacity and more sliding quietness and smoothness for various types of drawers, that also has increased available standing drawer volume.

SUMMARY OF THE INVENTION

The task of the innovation is solved by the drawer slide of the subject invention including one cabinet rail and one drawer rail having rollers and corresponding slide tracks and characterized by the cabinet body rail and drawer rail being mounted horizontally adjacent to one another and under the bottom of a drawer.

Hereby, it is provided that the cabinet body rail and the drawer rail are placed next to each other and are no longer one upon the other. The rails are fastened on the underside of the drawer bottom.

The innovative drawer slide no longer decreases the available standing width of the drawer because of the slide rails. At the same time, the vertical installation height is reduced so that the rails are next to each other and are not placed on top of each other.

It is hereby possible that either the cabinet body rails are placed on the inner side of the drawer rail or the reverse arrangement can be chosen in which the cabinet body rails are placed on the outside of the drawer rails, respectively referred to the drawer center. The respective rotation axles of the rollers of the rails lie, hereby, parallel to one another practically side by side. The vertical distance of the axles is consequently very slight and in every provided example for application is smaller than the radius of the respective utilized rollers.

To improve the quietness and smoothness of the glide and the lateral slide, the drawer rail is somewhat wave-shaped, forming a lengthwise groove. This lengthwise groove serves to take up the roller of the cabinet body rail. On the turned side of the drawer side wall, the drawer rail is bent in a faceted manner on its end. Through this, a recess is formed on the edge of the drawer bottom. Namely, it has been shown that frequently a residue of glue is on the joint between the drawer bottom and the drawer side wall, which at least partially fills up the respective resulting corner. Still, in order to achieve a dependable fastening of the drawer rail to the drawer bottom, the drawer rail is bent in a faceted manner on the respective end.

To fasten the drawer back wall and to store the running roller of the drawer, the drawer rail is provided with a connection angle on the backside of its end. This connection angle has more recesses to fasten the drawer back wall and is either made in one integral piece of material together with the drawer rail or made separately and then connected with the drawer rail by means of a suitable fastening means, such as gluing, welding, pressing, riveting, forming or connected by other ways and means.

Beyond that, it has been shown that the cabinet body with the installed drawers is relatively often turned upside down. In order to prevent the drawers from falling out of the respective rails, a safety device to prevent the drawers from falling out is provided.

The cabinet body rail has a somewhat C-shaped profiled receptacle to take up the drawer rollers. The drawer roller and the recess match so well with each other that the drawer roller has only a slight vertical play in the receptacle.

The front end of the cabinet body rail is provided with a connection angle to fasten to the cabinet body and to store the roller. Here, also, either an integral single piece material connection can be provided or the connection angle can be made separately from the cabinet body rail and be connected in an analogous manner, as the connection angle of the drawer rail.

The cabinet body rail is either directly, or by means of a connection piece or adapter, fastened to the back wall of the cabinet body and is supported with its front end on the additional frame which is fastened in turn to the cabinet body. Naturally, however, it is likewise possible to fasten the cabinet body rail on the respective side wall of the cabinet body.

It is hereby provided in a first embodiment that the axle of the roller of the cabinet body rail is simply stored. In a second embodiment it is provided that this axle is placed in two positions so that an increased carrying capacity of the complete slide is attained.

It is preferred that the respective rollers be guided self-centering in the corresponding slide tracks. This ensures that lateral "starting" noises are prevented when the drawer is pushed in or pulled out. In order to make a friction free extension of the drawer possible, this embodiment design provides the rollers on a drawer side, which are stored with very little lateral play on the respective axles. So the rollers of the axles can be shifted in order to balance out any eventual production or installation inaccuracies.

To make the handling and installation easier, intake diagonals and stops to restrict the maximum extension path of the drawer and insertion stops are attached.

The basis of the submitted innovation results from not only the matter of the particulars of the claims, but also the various combinations of the individual claims.

All records, documents and evidence, inclusive of the abstract, open and disclosed statements and declarations and indications and features, especially those represented embodiments in the drawings, will be claimed as fundamental and significant inventions, as far as the claims individually or in combinations are relative to the position that the technology is new.

The innovation at hand will be explained more precisely by the various embodiments shown by the representational drawings. Hereby, additional significant features and advantages of the innovation will be concluded from the designs and their descriptions.

Figure 7:
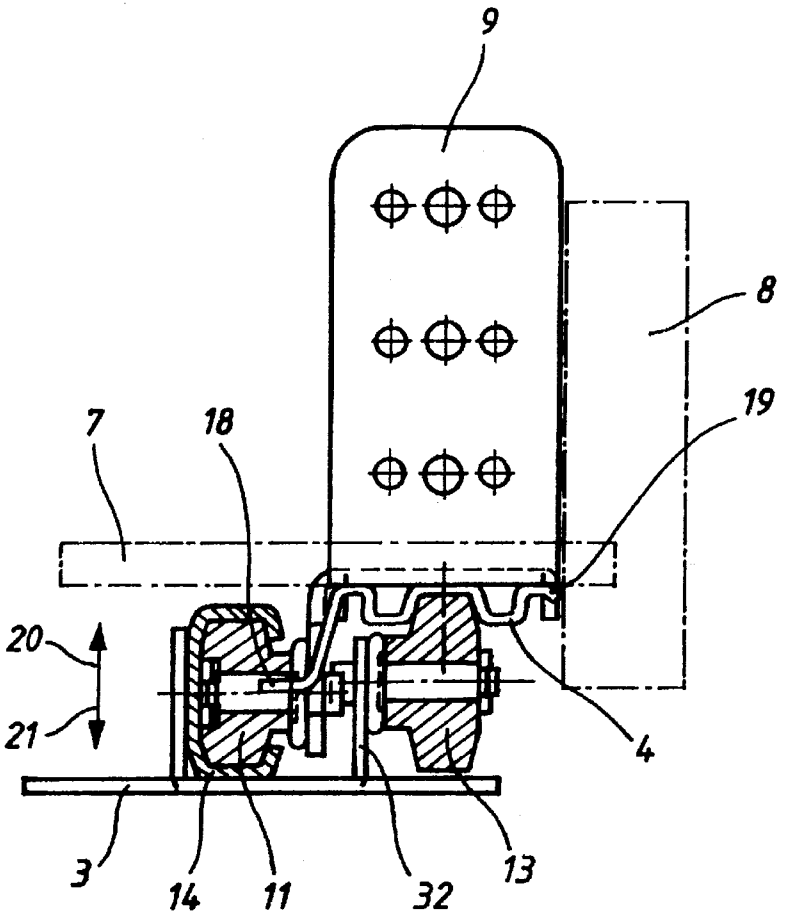
FIGS. 6 and 7: Representations, according to FIGS. 2 and 3, respective to 4 and 5 in the assembled state.
Figure 6:
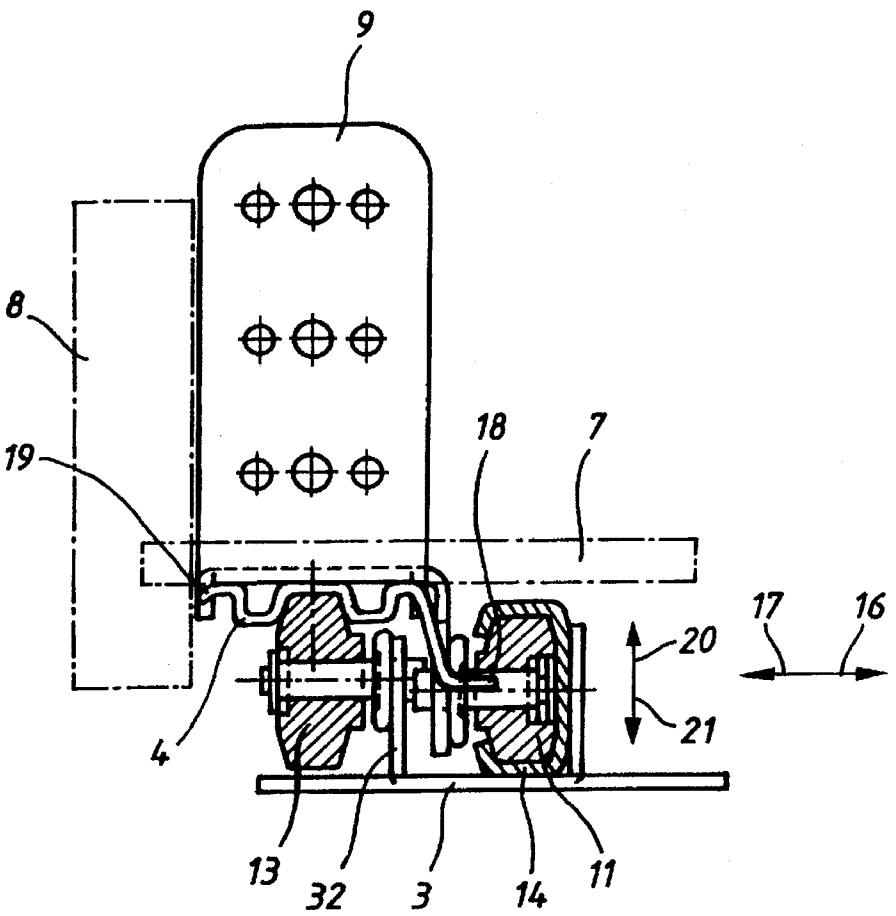
Figure 9:
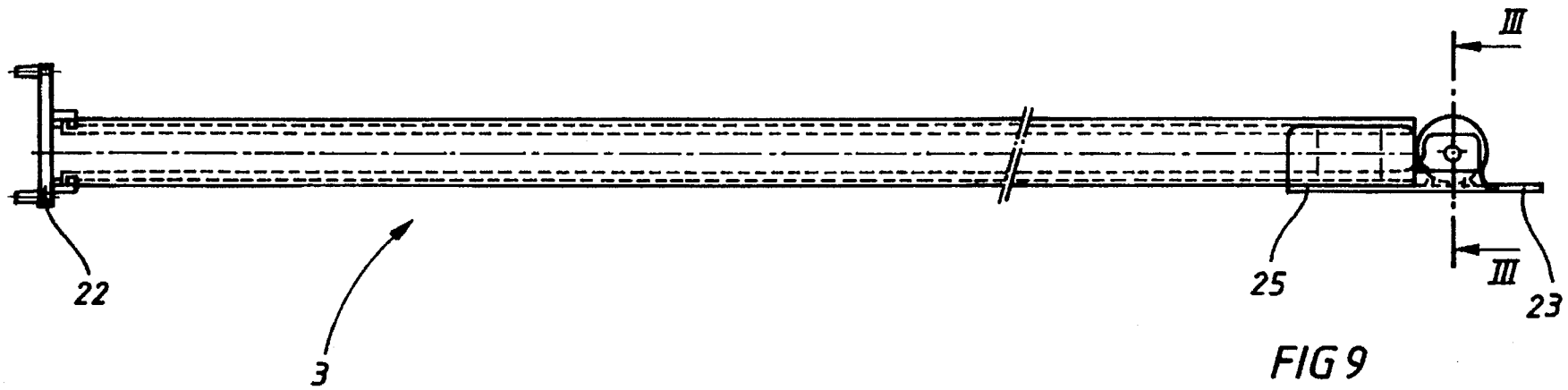
Figure 11:
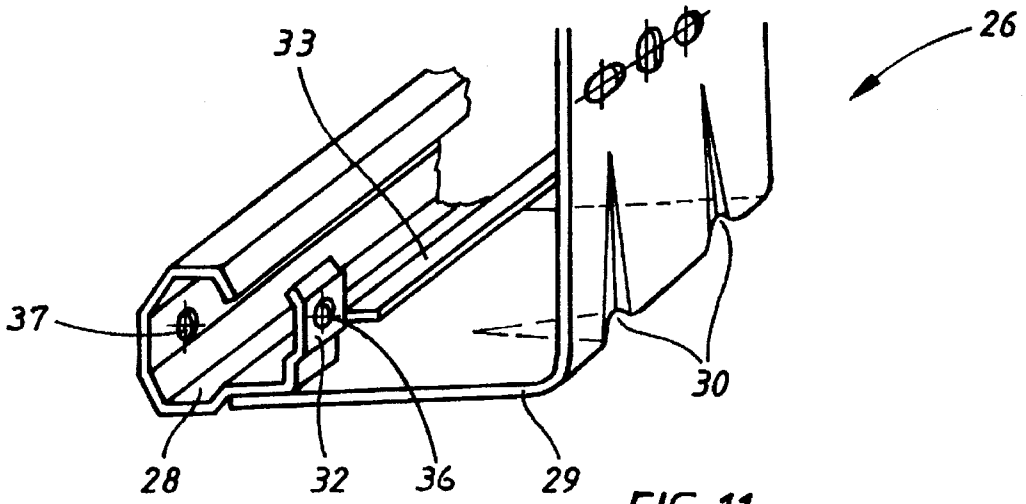
Figure 10:
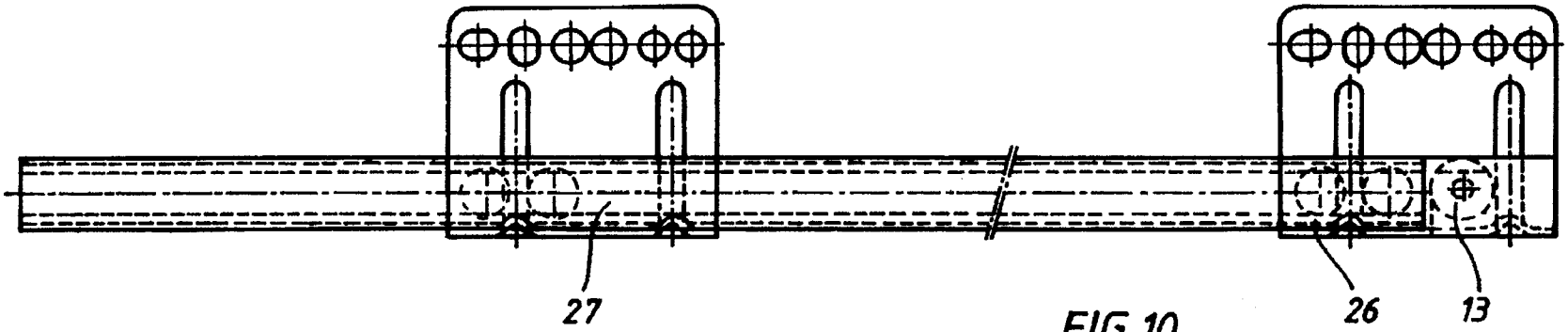
Figure 13:
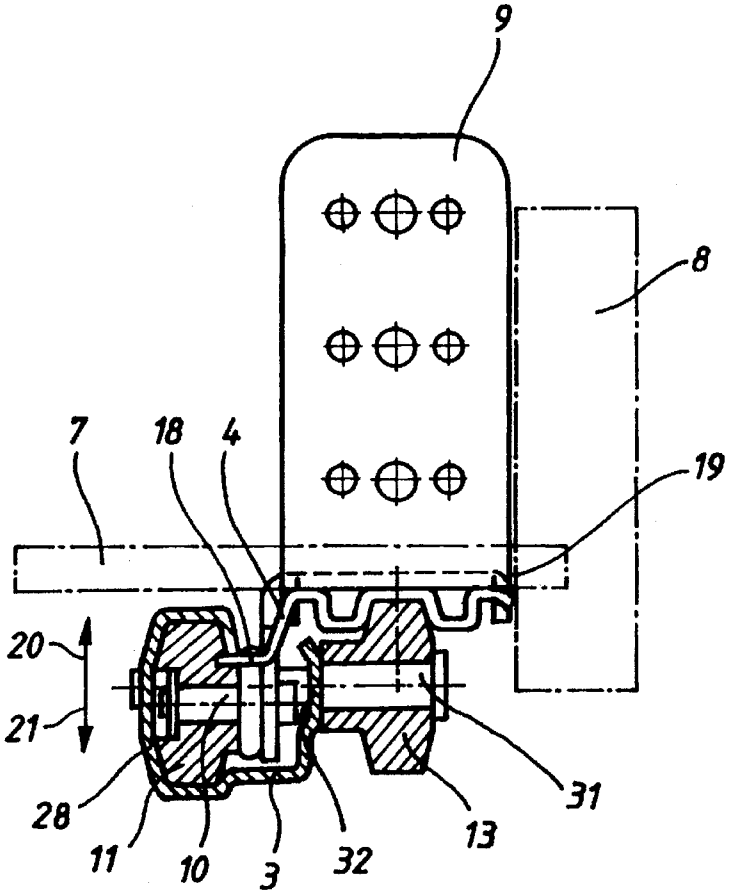
Figure 12:
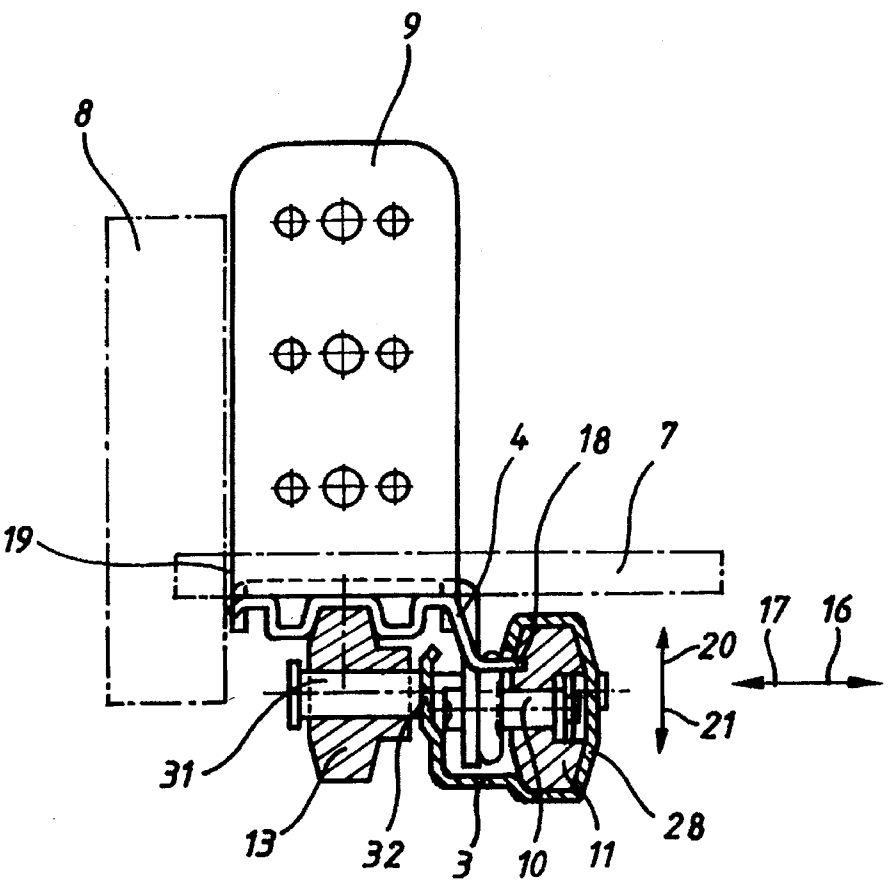

a side view of the cabinet body rail;

FIG. 10: side view, according to FIG. 9, in a second embodiment;

FIG. 11: a perspective representation of a connection angle for the cabinet body rail FIG. 12: a view, according to FIG. 6, in a second embodiment;

FIG. 13: a view, according to FIG. 7, in a second embodiment.

DESCRIPTION OF THE PREFERRED EMBODIMENTS

Figure 1:
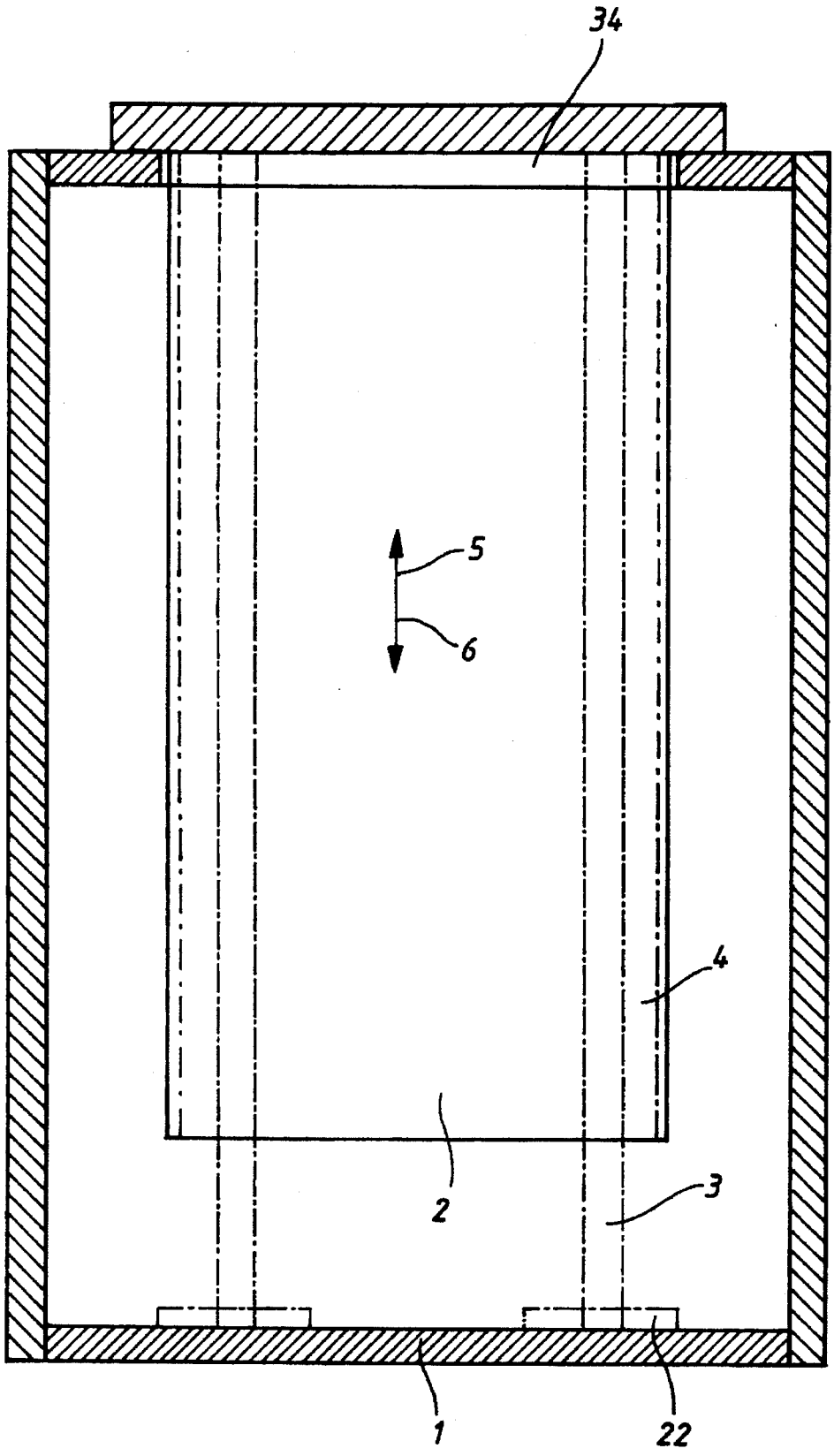
FIG. 1: top view of the drawer in the retracted position in a first embodiment.
Figure 4:
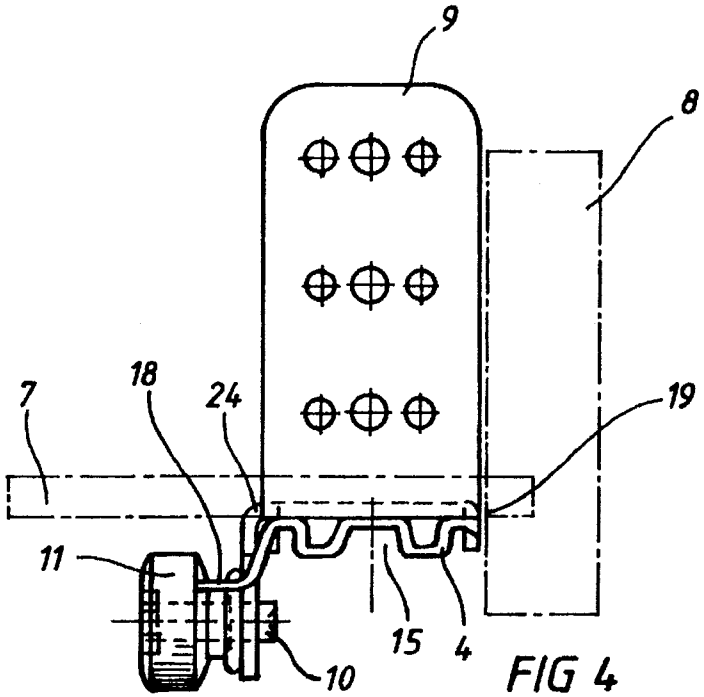
FIGS. 4 and 5: Each a representation, according to FIGS. 2 and 3 for the oppositely lying drawer side.

According to FIG. 1, a drawer (2) is placed slidable in a cabinet body (1) by means of two each cabinet body rails (3) and two each drawer rails (4) in arrow directions (5,6). Thereby, the cabinet body rail (3) is fastened with its back side end to the back wall of the cabinet body (1) with the help of a connection piece (22), while the front end of the cabinet body rail (3) is fastened to a frame (34) which is attached on the front side of the cabinet body (1).

FIGS. 2, 3 or 4, 5 show respectively the left or the right view of the drawer rail (4) and the cabinet body rail (3) with the corresponding built-on pieces. A drawer bottom (7) is provided on which the side drawer side walls (8) are placed. The drawer back wall (not represented) is fixed to the fastening tabs (9), which have corresponding recesses.

The drawer rail (4) is formed basically wave-shaped. This, on the one hand, can result in a greater stiffness or rigidity with less material weight, and on the other hand, a groove (15) is hereby formed that has slightly slanted side walls so that the corresponding roller (13) of the cabinet body rail (3) is held self-centering in the groove (15).

Each of the turned ends of the drawer rail (4) on the drawer side wall (8) is bent downward so that a recess (19) is formed. This recess (19) is necessary because frequently after the drawer bottom (7) and the drawer side wall (8) are assembled, there remains a residue of glue in this area.

On the opposite end, the drawer rail (4) runs somewhat Z-shaped in a safety device to prevent falling out.

The drawer rail (4) has a connection angle (24) which, on the one hand carries the fastening tabs (9) and, on the other hand, serves to store the roller (11) of the drawer rail (4). The roller (11) runs on an axle (10).

Figure 5:
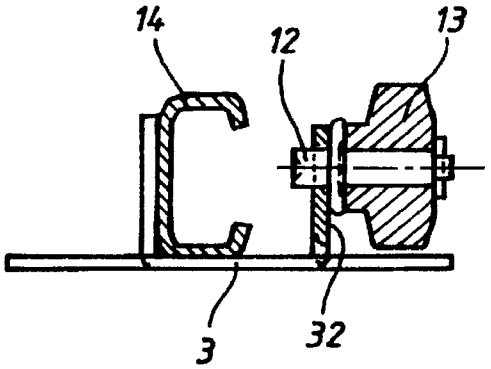
Figure 2:
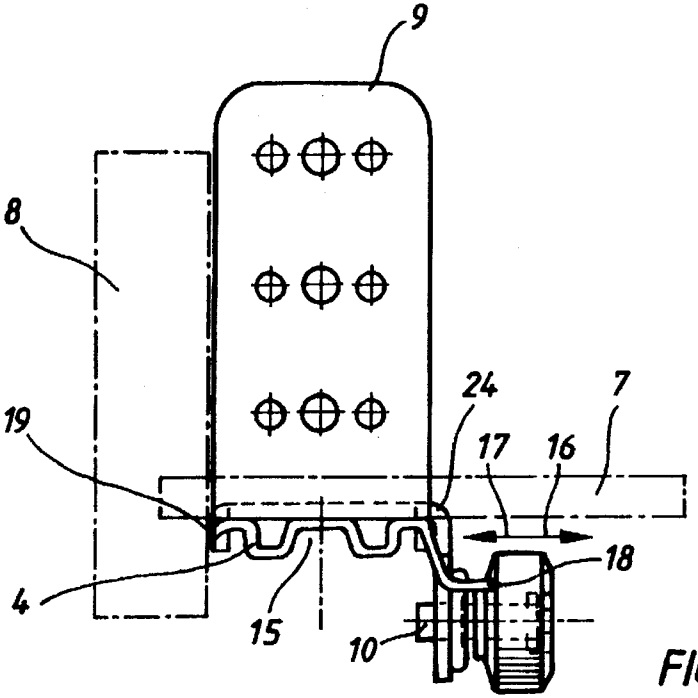
FIG. 2: a section along the Line II—II in FIG. 8.
Figure 3:
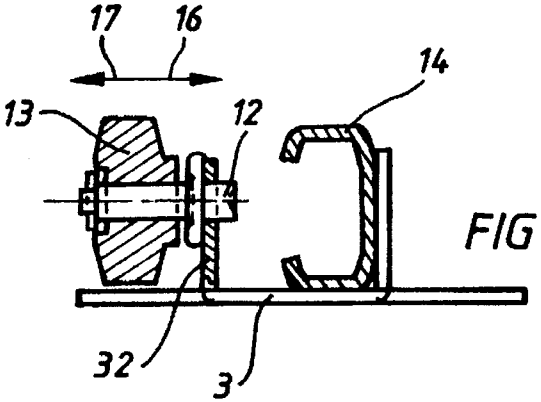
FIG. 3: a section along the Line III—III in FIG. 9.

The cabinet body rail (3) consists, according to the FIGS. 3 and 5, fundamentally of a somewhat C-shaped receptacle (14) for the receptacle of the roller (11), as well as a connection tab (32) for the axle (12) which carries the corresponding roller (13) in the cabinet body rail (3).

With the shown embodiment example, it is essential that on one of the drawer sides (in this case the left side), a lateral play in the arrow directions (16, 17) of the rollers (11, 13) on the axles (10, 12) is provided. Because the rollers are held self-centering in the respective slide tracks ( 14, 15), a movement of the rollers in a lateral direction on the respective axles is required, so that the necessary sliding quietness, smoothness and the easy sliding of the drawer are guaranteed.

The rollers (11, 13) are likewise held by the edges and supported so the self-centering effect takes place through the sliding tracks ( 14, 15).

FIGS. 6 and 7 respectively show the assembled state of the building components, according to FIGS. 2–5. It is clear that the safety device to prevent falling out (18) in the assembled state engages in the inner space of the receptacle (14) so that lifting the drawer (2) in the arrow direction (20) from the cabinet body rail (3) is not possible.

It is hereby still essential that the roller (11 ) has play in the vertical direction in arrow directions (20, 21) in the receptacle. In case the drawer is completely pushed in, the roller (11) lies on the underside of the receptacle (14). When the drawer is pulled out, the pressure acting against the roller (11) on the underside of the receptacle (14) always becomes smaller because the center of gravity has shifted. Finally, as soon as the center of gravity of the drawer is moved out over the roller (13) of the cabinet body, the roller (11) lies against the upper side of the receptacle (14). In contrast to the lateral play in arrow directions (16, 17), this vertical play in arrow direction (20, 21) is provided on both sides of the drawer.

Figure 8:
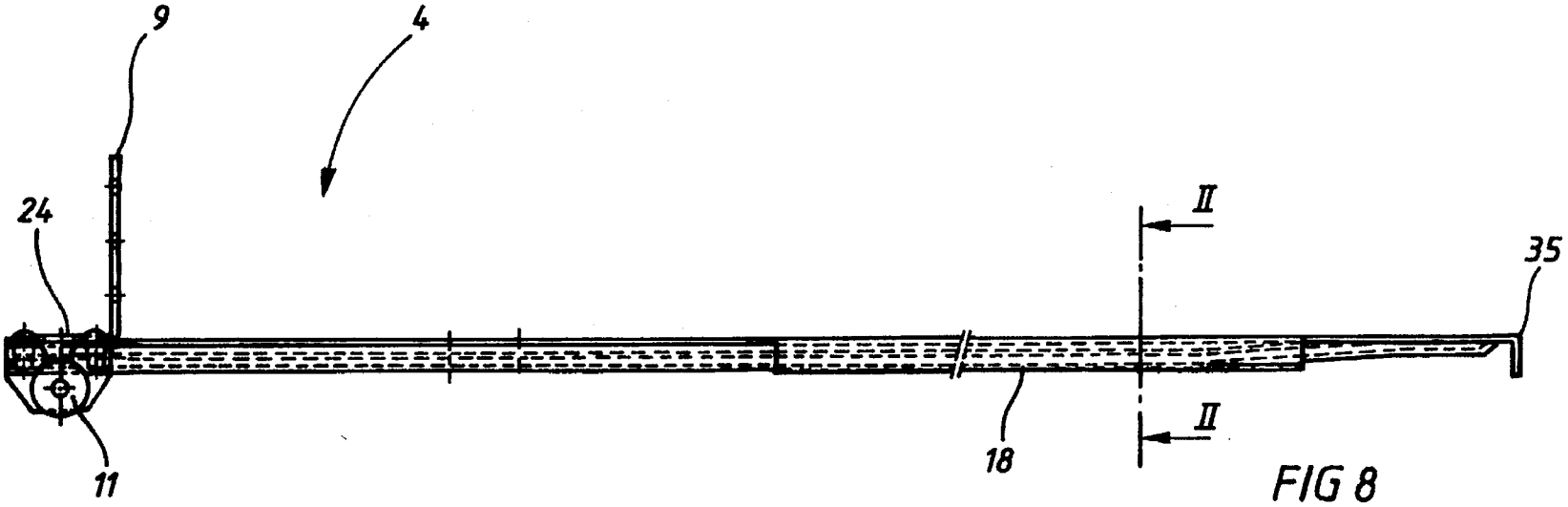
FIG.8: a side view of the drawer rail.

FIG. 8 shows a side view on the drawer rail (4). It is clearly shown that the drawer rail (4) has on its back side end a connection angle (24), which not only has the fastening tabs (9) for fastening the back wall, but also is utilized for taking in the roller (11).

On the front end of the drawer rail (4), as shown in an embodiment example, a hook is attached which is fastened on the drawer front side. It is self-explanatory that it is likewise possible, in place of the hook (35), to provide a cylindrical radial resilient spring piece or part, which can be inserted in a corresponding bore hole on the drawer front side.

In a section of the length of the drawer rail (4), a safety device to prevent the drawer from falling out (18) is attached.

FIG. 9 shows a side view of the cabinet body rail (3). In this embodiment example, a connection piece (22) is also represented that serves to fasten the cabinet body rail (3) to the back wall of the cabinet body (1). The connection piece (22) can hereby either be fastened by means of screws on the back wall of the cabinet body or have pegs or posts which can be inserted in the corresponding bore holes. Therefore, the fastening then results in the front end (23) of the cabinet body rail (3) being fixed axially stationary either to the cabinet body (1) or to a frame (34) as shown in FIG. 1.

FIG. 10 shows an additional embodiment example for the cabinet body rail (3). Here, instead of the placement to the front and back wall of the cabinet body (1), two connection angles (26, 27) are provided which will each be fastened to the side wall of the cabinet body (1).

Not only in FIG. 9, but also in FIG. 10, the respective connection angles (25, 26, 27) serve to take in and hold the roller (13).

FIG. 11 shows an enlarged perspective representation of a connection angle (26). In this embodiment example, it is provided that the axle (12) of the cabinet body rail (3) is doubly held.

Here the axle (13) not only is held in a corresponding recess (36) of the tab (32), but also in a recess (37) of the receptacle (28) which corresponds fundamentally to the receptacle (14). To additionally strengthen the cabinet body (3), a rib (33) is provided which stretches over the entire length or only a section of the length of the cabinet body rail (3).

An angle (29) is provided to fasten to the side wall of the cabinet body and in a suitable manner is connected to the cabinet body rail (3). This angle (29) has reinforcement beading (30) and has recesses for fastening to the cabinet body side wall.

FIGS. 12 and 13 show another embodiment example of the assembled drawer slide corresponding to FIGS. 6 and 7. Hereby, the fastening of the cabinet body rail (3) results from either (according to FIG. 1) the front and back wall of the cabinet body or from the angle (29) (not more closely described and represented) to the side walls.

Because the given representations here correspond fundamentally to FIG. 6 and 7, only the differences of these Figures are more closely represented and described.

In the embodiment shown here, the axle (31) of the cabinet body rail (3) is held in two places; namely, on the one hand, in tab (32) and, on the other hand, in the receptacle (28). This leads to a greater rigidity and stiffness of the cabinet body rail and, thus, to a total greater carrying capacity of the drawer.

Naturally, here also, the lateral play in arrow directions (16, 17) on a side of the drawer slide, as well as the vertical play in arrow directions (20,21) on both sides of the drawer are provided.

With the innovative drawer slide it is possible to considerably increase the available standing drawer volume; whereby, simultaneously, a greater carrying capacity and a quieter and smoother glide of the drawer slide is attained.

DRAWINGS LEGEND

1. Cabinet body
2. Drawer
3. Cabinet body rail
4. Drawer rail
5. Arrow direction
6. Arrow direction
7. Drawer bottom
8. Drawer side wall
9. Fastening tabs
10. Axle
11. Roller
12. Axle
13. Roller
14. Receptacle
15. Groove (to 4)
16. Arrow direction
17. Arrow direction
18. Safety device to prevent drawers from falling out
19. Recess
20. Arrow direction
21. Arrow direction
22. Connecting piece
23. Front end
24. Connection angle
25. Connection angle
26. Connection angle
27. Connection angle
28. Receptacle (to 3)
29. Angle
30. Reinforcement beading
31. Axle (to 4)
32. Tab
33. Rib
34. Frame
35. Hook

What is claimed is:

1. A drawer slide for maximizing available standing drawer volume, said drawer slide comprising:

a cabinet body rail including a slide track having opposite sides and a roller positioned along one side of the slide track;

a drawer rail including a slide track having opposite sides and a roller positioned along one side of the slide track, said drawer rail being assembled horizontally adjacent to said cabinet body rail whereby said drawer rail and said cabinet body rail are side by side forming an assembled drawer slide;

wherein the roller of said cabinet body rail engages the horizontally adjacent slide track of said drawer rail and the roller of the drawer rail engages the horizontally adjacent slide track of said cabinet body rail in the assembled drawer slide;

an axle secured to said cabinet body rail and an axle secured to said drawer rail;

wherein said rollers are rotatably mounted on said axles, said axles being positioned substantially parallel to each other;

said cabinet body rail further including a connection angle on the cabinet body rail comprising:

a connection tab having a first recess for receiving said axle supporting the roller of said cabinet body rail;

a receptacle for receiving the roller of said cabinet body rail, said receptacle including a second recess for receiving said axle supporting the roller of said cabinet body rail; and wherein said axle has opposite ends and one end is located in the first recess and the other end is located in the second recess.

2. A drawer slide for mounting a drawer in a cabinet body and maximizing the volume of a drawer to be installed, said drawer slide comprising:

a drawer having a front wall, back wall, opposite side walls and a drawer bottom;

a cabinet body rail mounted on a cabinet body, said cabinet body rail including a roller and a slide track;

a drawer rail mounted under said drawer bottom, said drawer rail including a roller and a slide track on one side of the roller;

wherein said drawer rail is positioned horizontally adjacent to said cabinet rail whereby the roller of the cabinet rail engages the slide track of the drawer rail and the roller of the drawer rail engages the slide trade of the cabinet body rail, and wherein said rails are attached side by side and slidably engage one another for sliding the drawer between a closed, pushed in position and an open, pulled out position;

said drawer rail further including a connection angle for fastening said drawer rail to the drawer back wall and for holding the roller on the drawer rail; and said drawer rail further including a fastening tab attached to said connection angle for fastening said drawer rail to the drawer back wall.

3. A drawer slide for mounting a drawer in a cabinet body and maximizing the volume of a drawer to be installed, said drawer slide comprising:

a drawer having a front wall, back wall, opposite side walls and a drawer bottom;

a cabinet body rail mounted on a cabinet body, said cabinet body rail including a roller and a slide track;

a drawer rail mounted under said drawer bottom, said drawer rail including a roller and a slide track on one side of the roller;

wherein said drawer rail is positioned horizontally adjacent to said cabinet rail whereby the roller of the cabinet rail engages the slide track of the drawer rail and the roller of the drawer rail engages the slide track of the cabinet body rail, and wherein said rails are attached side by side and slidably engage one another for sliding the drawer between a closed, pushed in position and an open, pulled out position;

said cabinet body rail further including a connection angle on the cabinet body rail for fastening said cabinet body rail to a cabinet body and for securing the roller of said cabinet body rail to said cabinet body rail;

wherein said connection angle is positioned on a side wall of a cabinet, said connection angle including a plurality of recesses for mounting said cabinet body rail;

said connection angle further including a receptacle for receiving the roller of said drawer rail; and said connection angle further including a connection tab having a first through hole for receiving one end of the axle for supporting the roller of the cabinet body rail.

4. A drawer slide according to claim 3, said receptacle further including a second through hole for receiving the opposite end of the axle for supporting the roller of the cabinet rail.

* * * * *